US011821423B2

(12) United States Patent
Watabe et al.

(10) Patent No.: US 11,821,423 B2
(45) Date of Patent: Nov. 21, 2023

(54) SCROLL COMPRESSOR WITH INCLINED WALL SURFACE EXTENDING FROM THE DUST WRAP

(71) Applicant: Hitachi Industrial Equipment Systems Co., Ltd., Tokyo (JP)

(72) Inventors: Yusuke Watabe, Tokyo (JP); Yoshiyuki Kanemoto, Tokyo (JP); Yoshio Kobayashi, Tokyo (JP); Hiroaki Saito, Tokyo (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 0 days.

(21) Appl. No.: 17/797,612

(22) PCT Filed: Jul. 20, 2020

(86) PCT No.: PCT/JP2020/028017
§ 371 (c)(1),
(2) Date: Aug. 4, 2022

(87) PCT Pub. No.: WO2022/018784
PCT Pub. Date: Jan. 27, 2022

(65) Prior Publication Data
US 2023/0069695 A1 Mar. 2, 2023

(51) Int. Cl.
*F04C 18/02* (2006.01)
*F04C 29/00* (2006.01)
(Continued)

(52) U.S. Cl.
CPC ..... *F04C 18/0269* (2013.01); *F04C 18/0215* (2013.01); *F04C 18/0261* (2013.01);
(Continued)

(58) Field of Classification Search
CPC ..... F04C 2/025; F04C 18/0207–0292; F04C 15/0096; F04C 15/0034; F04C 29/0007;
(Continued)

(56) References Cited

U.S. PATENT DOCUMENTS 6,213,742 B1 * 4/2001 Goto ..... F04C 18/0253 418/55.2
2005/0232799 A1 * 10/2005 Sato ..... F04C 27/008 418/55.6
(Continued)

FOREIGN PATENT DOCUMENTS

JP 61-126396 A 6/1986
JP 8-68386 A 3/1996
(Continued)

OTHER PUBLICATIONS

International Preliminary Report on Patentability (PCT/IB/338 & PCT/IB/373) issued in PCT Application No. PCT/JP2020/028017 dated Feb. 2, 2023, Including English translation of document C2 (Japanese-language Written Opinion (PCT/ISA/237), filed on Aug. 4, 2022) (six (6) pages).
(Continued)

*Primary Examiner* — Laert Dounis
(74) *Attorney, Agent, or Firm* — Crowell & Moring LLP

(57) ABSTRACT

Provided is a scroll compressor that can prevent liquid from being accumulated, the scroll compressor including: a fixed scroll; an orbiting scroll; and a rotation shaft that extends in the horizontal direction and causes the orbiting scroll to orbit relative to the fixed scroll. Liquid is injected into a working chamber. An enclosing point of a working chamber formed near the outer end of a fixed wrap of the fixed scroll is positioned below a center of the rotation shaft and at the lowest point of the contour of the working chamber having shifted to the lowest position. The fixed scroll has an inclined wall surface that is positioned below the center of
(Continued)

the rotation shaft, is made to face upward, and extends from the dust wrap to the outer end of the fixed wrap. The inclined wall surface is formed so as to be sloped down gradually from the dust wrap toward the outer end of the fixed wrap.

6 Claims, 6 Drawing Sheets

(51) Int. Cl.

| | |
|---|---|
| ***F04C 27/00*** | (2006.01) |
| ***F04C 27/02*** | (2006.01) |
| ***F04C 29/04*** | (2006.01) |

(52) U.S. Cl.
CPC ..... *F04C 27/008* (2013.01); *F04C 29/0007* (2013.01); *F04C 27/02* (2013.01); *F04C 29/042* (2013.01)

(58) Field of Classification Search
CPC .. F04C 29/0014; F04C 29/042; F04C 29/008; F01C 1/0207–0292; F01C 21/001; F01C 21/002
See application file for complete search history.

(56) References Cited

U.S. PATENT DOCUMENTS

| | | | |
|---|---|---|---|
| 2016/0362127 | A1 | 12/2016 | Inada et al. |
| 2020/0036269 | A1 | 1/2020 | Sugiura |
| 2021/0156382 | A1 | 5/2021 | Sato et al. |

FOREIGN PATENT DOCUMENTS

| | | | | | |
|---|---|---|---|---|---|
| JP | 8-210279 | A | | 8/1996 | |
| JP | 2001355588 | A | * | 12/2001 | ..... F01C 1/0223 |
| JP | 2011-185247 | A | | 9/2011 | |
| JP | 2015-113071 | A | | 6/2015 | |
| JP | 2019-35386 | A | | 3/2019 | |
| JP | 2020-18087 | A | | 1/2020 | |
| JP | 2020186659 | A | * | 11/2020 | |
| KR | 10-2013-0094646 | A | | 8/2013 | |

OTHER PUBLICATIONS

International Search Report (PCT/ISA/210) issued in PCT Application No. PCT/JP2020/039916 dated Dec. 15, 2020 with English translation (five (5) pages).
Japanese-language Written Opinion (PCT/ISA/237) issued in PCT Application No. PCT/JP2020/039916 dated Dec. 15, 2020 (four (4) pages).

* cited by examiner

SCROLL COMPRESSOR WITH INCLINED WALL SURFACE EXTENDING FROM THE DUST WRAP

TECHNICAL FIELD

The present invention relates to a scroll compressor that compresses gas while injecting liquid.

BACKGROUND ART

Patent Document 1 discloses a scroll compressor that compresses air (gas) while injecting water (liquid). This scroll compressor includes a fixed scroll, an orbiting scroll, and a rotation shaft. The fixed scroll has: a mirror plate; a fixed wrap that is arranged upright on the mirror plate and extends helically; and an annular dust wrap that is arranged upright on the mirror plate and arranged on the outer circumference side of the fixed wrap. The dust wrap prevents dust from entering working chambers mentioned later.

The orbiting scroll has: a mirror plate; and an orbiting wrap that is arranged upright on the mirror plate and extends helically. The rotation shaft extends in the horizontal direction and has a crank portion that is eccentric with respect to the center of the rotation shaft. This crank portion is connected to the orbiting scroll. Rotation of the rotation shaft causes the orbiting scroll to orbit relative to the fixed scroll.

A plurality of working chambers are formed between the fixed wrap and the orbiting wrap. Each working chamber shifts from the outer side to the inner side in the wrap extension direction along with an orbiting motion of the orbiting wrap, and sequentially performs an intake process of taking in air, a compression process of compressing the air, and a discharge process of discharging the compressed air.

A water supply piping system injects water into the upstream side of the working chambers. This provides an effect of sealing very small gaps between members forming the working chambers, and an effect of suppressing the gaps mentioned before becoming large by absorbing compression heat and preventing thermal deformation of each member. As a result, leakage of air from the working chambers is reduced, and the efficiency is enhanced.

However, there is a possibility that part of water is not taken into the working chambers and is accumulated in a space between the dust wrap and the fixed wrap (in particular, a space below the center of the rotation shaft). Accordingly, in Patent Document 1, a drain hole is formed at a lower portion of the dust wrap, and a water conduit pipe is provided that leads water discharged from the drain hole out to the upstream side of the working chambers.

PRIOR ART DOCUMENT

Patent Document

Patent Document 1: JP-2011-185247-A (see FIG. 5)

SUMMARY OF THE INVENTION

Problem to be Solved by the Invention

However, in Patent Document 1, since not only the drain hole of the dust wrap, but the water conduit pipe is required, the structure becomes complicated.

The present invention has been made in view of the matter described above, and one of objects of the present invention is to prevent liquid from being accumulated by using a simple structure.

Means for Solving the Problem

In order to solve the problem described above, configurations described in Claims are applied. The present invention includes a plurality of means for solving the problem described above, and an example thereof is a scroll compressor including: a fixed scroll having a mirror plate, a fixed wrap that is arranged upright on the mirror plate, and extends helically, and an annular dust wrap that is arranged upright on the mirror plate and arranged on an outer circumference side of the fixed wrap; an orbiting scroll having a mirror plate and an orbiting wrap that is arranged upright on the mirror plate and extends helically; and a rotation shaft that extends in a horizontal direction and causes the orbiting scroll to orbit relative to the fixed scroll, wherein the mirror plate of the fixed scroll has a liquid injection hole positioned above a center of the rotation shaft, liquid is injected to a working chamber via the liquid injection hole and a flow path between the dust wrap and the orbiting wrap, the working chamber being formed near an outer end of the fixed wrap and on an inner side in a widthwise direction of the fixed wrap, an enclosing point where the gas is enclosed in the working chamber and where compression is started is positioned below the center of the rotation shaft and positioned at a lowest point on a contour of the working chamber having shifted to a lowest position or positioned on an outer side of the lowest point in the wrap extension direction, the fixed scroll further has an inclined wall surface that is positioned below the center of the rotation shaft, is made to face upward, and extends from the dust wrap to the outer end of the fixed wrap, and the inclined wall surface has a shape that is sloped down gradually from the dust wrap toward the outer end of the fixed wrap.

Advantages of the Invention

According to the present invention, it is possible to prevent liquid from being accumulated by using a simple structure.

Note that problems, configurations, and advantages other than those described above will become clear from the following explanation.

MODES FOR CARRYING OUT THE INVENTION

One embodiment to which the present invention is applied is explained with reference to the figures.

Figure 1:
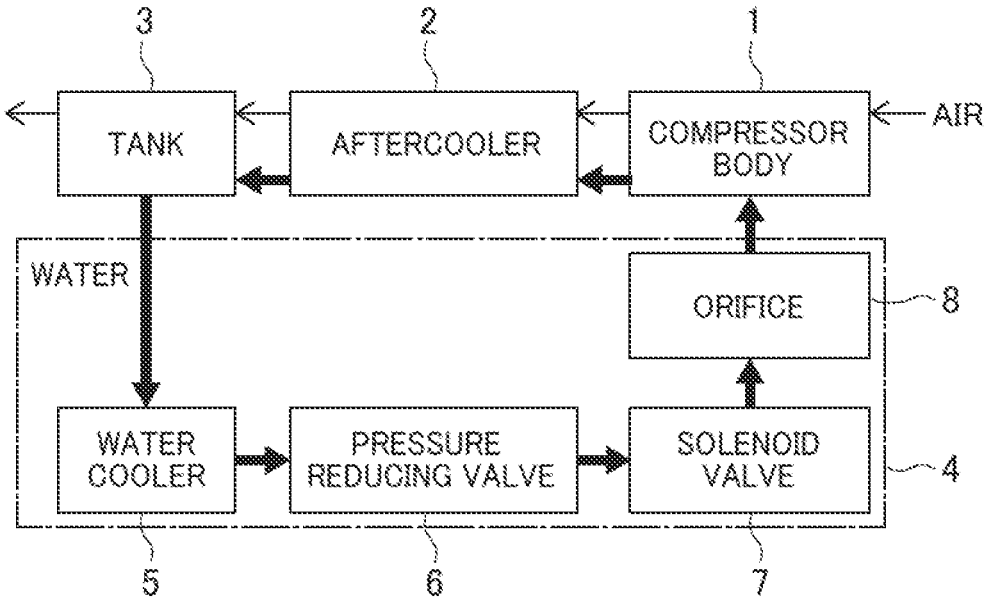
FIG. 1 is a block diagram depicting the configuration of a scroll compressor in one embodiment to which the present invention is applied.
Figure 2:
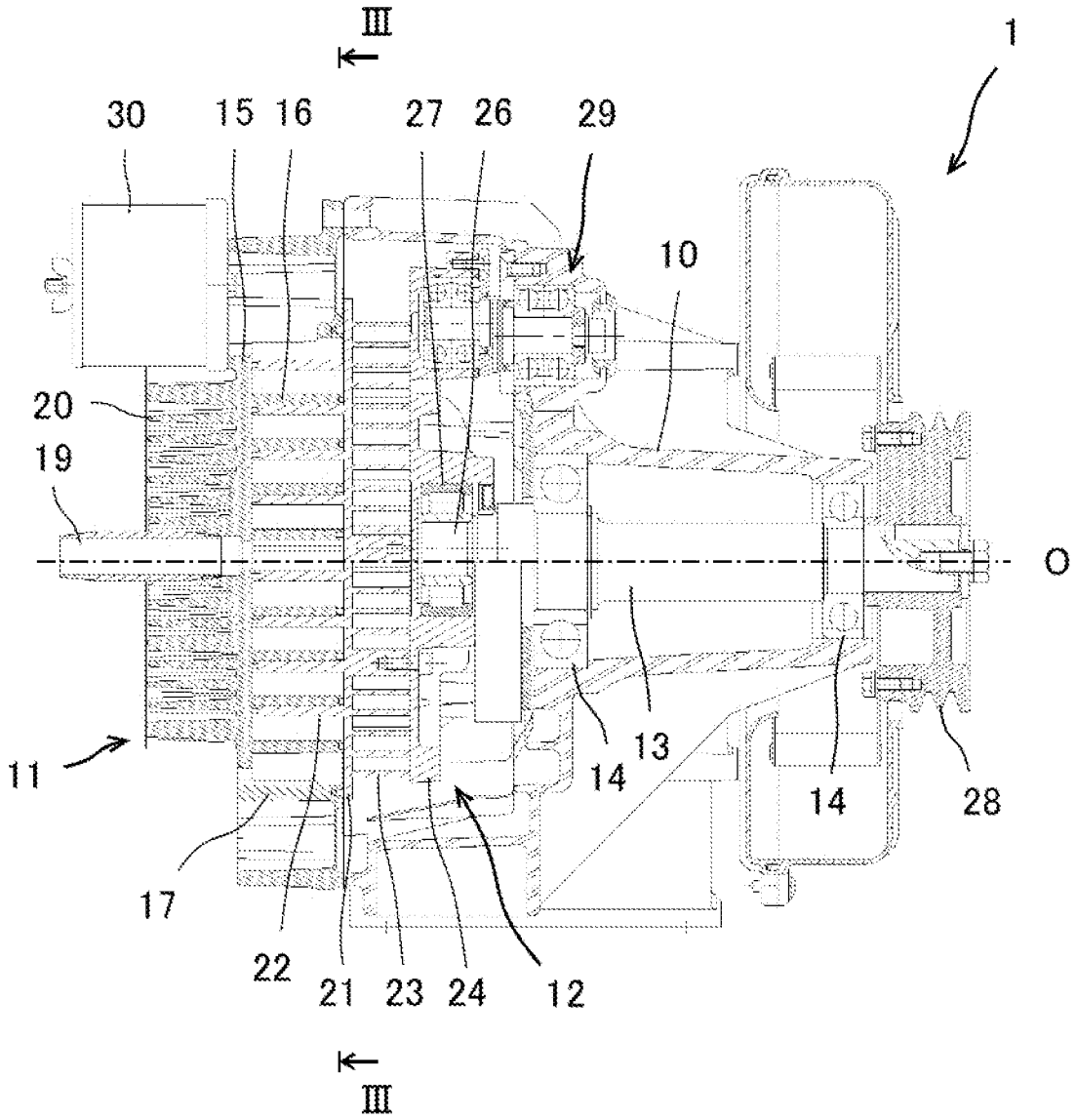
FIG. 2 is an axial cross sectional view depicting the structure of a compressor body in the one embodiment to which the present invention is applied.
Figure 3:
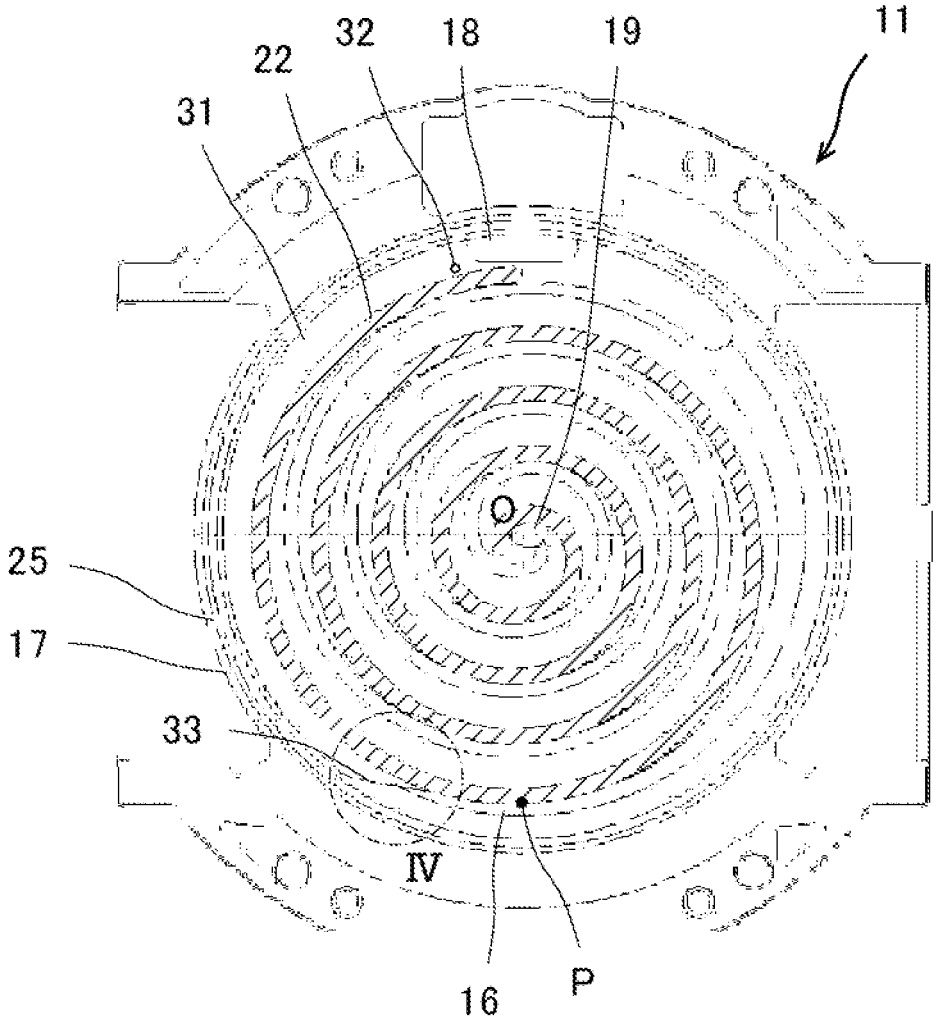
FIG. 3 is a radial cross sectional view in the direction of arrows III-III in FIG. 2.
Figure 4:
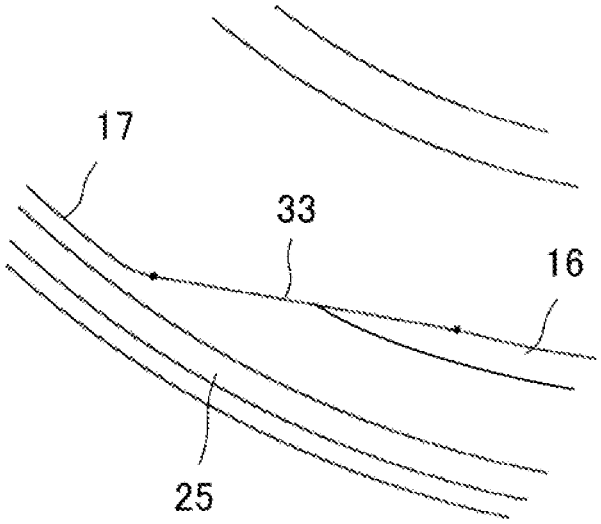
FIG. 4 is an enlarged view of a portion IV in FIG. 3, and depicts the structure of an inclined wall surface in the one embodiment according to the present invention.

FIG. 1 is a block diagram depicting the configuration of a scroll compressor in the present embodiment. FIG. 2 is an axial cross sectional view depicting the structure of a compressor body in the present embodiment. FIG. 3 is a radial cross sectional view in the direction of arrows III-III in FIG. 2. FIG. 4 is an enlarged view of a portion IV in FIG. 3. Note that whereas a face seal is depicted in FIG. 3, a tip seal is not depicted for convenience. In addition, whereas an orbiting wrap is depicted in FIG. 3, the orbiting wrap is not depicted in FIG. 4 for convenience.

The scroll compressor according to the present embodiment includes a compressor body 1, an aftercooler 2, a tank 3, and a water supply system 4 (liquid supply system). The compressor body 1 compresses air (gas) while water (liquid) supplied from the water supply system 4 is injected thereinto. The aftercooler 2 cools the compressed air that contains water and is discharged from the compressor body 1. The tank 3 temporarily stores the compressed air that contains water and is cooled by the aftercooler 2. The water introduced into the tank 3 is separated from the compressed air due to its own weight, and is stored at a lower portion of the tank 3.

By using pressure in the tank 3, the water supply system 4 supplies, to the compressor body 1, the water stored at the lower portion of the tank 3. The water supply system 4 has, for example, a water cooler 5 (liquid cooler) that cools water, a water filter (not depicted) that removes impurities in the water, a pressure reducing valve 6, a solenoid valve 7, and an orifice 8. A controller (not depicted) controls the degree of opening of the solenoid valve 7 to thereby control the timing and flow rate of water supply.

The compressor body 1 includes a casing 10, a fixed scroll 11, an orbiting scroll 12, and a rotation shaft 13. The fixed scroll 11 is coupled to the opening side of the casing 10. The orbiting scroll 12 is housed in the casing 10. The rotation shaft 13 is rotatably supported by bearings 14 in the casing 10.

The fixed scroll 11 has: an approximately circular mirror plate 15; a fixed wrap 16 that is arranged upright on one surface side (the right side in FIG. 2) of the mirror plate 15 facing the orbiting scroll 12, and extends helically; an annular dust wrap 17 that is arranged upright on the one surface side of the mirror plate 15, and arranged on the outer circumference side of the fixed wrap 16; an intake flow path 18 that communicates with a space between the fixed wrap 16 and the dust wrap 17 (specifically, a space above the center O of the rotation shaft 13); a discharge flow path 19 formed at a central portion of the mirror plate 15; and a cooling fin 20 arranged upright on the other surface side (the left side in FIG. 2) of the mirror plate 15. The dust wrap 17 prevents dust from entering working chambers mentioned later, and is arranged such that interference with the orbiting wrap mentioned later is avoided.

The orbiting scroll 12 has: an approximately circular mirror plate 21; an orbiting wrap 22 that is arranged upright on one surface side (the left side in FIG. 2) of the mirror plate 21 facing the fixed scroll 11, and extends helically; a cooling fin 23 arranged upright on the other surface side (the right side in FIG. 2) of the mirror plate 21; and a back plate 24 provided on the tip side (the right side in FIG. 2) of the cooling fin 23.

A seal groove is formed on the tip side (the left side in FIG. 2) of the orbiting wrap 22 facing the fixed scroll 11, and a tip seal that contacts the mirror plate 15 of the fixed scroll 11 is provided in the seal groove. A seal groove is formed on the tip side (the right side in FIG. 2) of the fixed wrap 16 facing the orbiting scroll 12, and a tip seal that contacts the mirror plate 21 of the orbiting scroll 12 is provided in the seal groove. A seal groove is formed on the tip side (the right side in FIG. 2) of the dust wrap 17 facing the orbiting scroll 12, and a face seal 25 that contacts the mirror plate 21 of the orbiting scroll 12 is provided in the seal groove.

The rotation shaft 13 extends in the horizontal direction (the leftward/rightward direction in FIG. 2), and one end side (the left side in FIG. 2) thereof is provided with a crank portion 26. The crank portion 26 is eccentric with respect to the center O of the rotation shaft 13, and is connected to a boss portion of the back plate 24 of the orbiting scroll 12 via a slewing bearing 27.

The other end side (the right side in FIG. 2) of the rotation shaft 13 protrudes to the outside of the casing 10, and is provided with a pulley 28. A belt (not depicted) is wrapped around the pulley 28 and a pulley (not depicted) provided to a rotation shaft (not depicted) of an electric motor. Thereby, rotational force of the electric motor is transferred to rotate the rotation shaft 13, and the orbiting scroll 12 orbits relative to the fixed scroll 11.

An autorotation prevention mechanism 29 for preventing autorotation of the orbiting scroll 12 is provided between the orbiting scroll 12 and the casing 10. The autorotation prevention mechanism 29 includes: a plurality of auxiliary crank shafts that are arranged spaced apart from each other in the circumferential direction of the rotation shaft 13; a plurality of bearings that are provided to the back plate 24 of the orbiting scroll 12, and support one end side of the plurality of auxiliary crank shafts; and a plurality of bearings that are provided to the casing 10, and support the other end side of the plurality of auxiliary crank shafts.

A plurality of first working chambers are formed between the fixed wrap 16 and the orbiting wrap 22 (specifically, on the inner side of the fixed wrap 16 in the widthwise direction, and on the outer side of the orbiting wrap 22 in the widthwise direction). Each first working chamber shifts from the outer side to the inner side in the wrap extension direction (counterclockwise in FIG. 3) along with an orbiting motion of the orbiting wrap 22, and sequentially performs an intake process of taking in air, a compression process of compressing the air, and a discharge process of discharging the compressed air. A first working chamber at the intake process is positioned near the outer end (i.e. an outer end portion in the wrap extension direction) of the fixed wrap 16, and takes in air via an intake filter 30, the intake flow path 18, and a flow path 31 between the dust wrap 17 and the orbiting wrap 22. A first working chamber at the discharge process discharges compressed air via the discharge flow path 19.

A plurality of second working chambers are formed between the orbiting wrap 22 and the fixed wrap 16 (specifically, on the inner side of the orbiting wrap 22 in the widthwise direction, and on the outer side of the fixed wrap 16 in the widthwise direction). Each second working chamber shifts from the outer side to the inner side in the wrap extension direction (counterclockwise in FIG. 3) along with an orbiting motion of the orbiting wrap 22, and sequentially performs an intake process of taking in air, a compression process of compressing the air, and a discharge process of discharging the compressed air. A second working chamber at the intake process is positioned near the outer end (i.e. an outer end portion in the wrap extension direction) of the orbiting wrap 22, and takes in air via the intake filter 30 and the intake flow path 18. A second working chamber at the discharge process discharges compressed air via the discharge flow path 19.

A water injection hole 32 (liquid injection hole) is formed in the mirror plate 15 of the fixed scroll 11 and near the outer end of the orbiting wrap 22. Along with an orbiting motion of the orbiting wrap 22, the water injection hole 32 is positioned alternately on the outer side and inner side of the orbiting wrap 22 in the widthwise direction. When the water injection hole 32 is positioned on the outer side of the orbiting wrap 22 in the widthwise direction, water from the water supply system 4 mentioned above is led out to a first working chamber at the intake process via the flow path 31 between the dust wrap 17 and the orbiting wrap 22, and the water injection hole 32. When the water injection hole 32 is positioned on the inner side of the orbiting wrap 22 in the widthwise direction, water from the water supply system 4 is led out to a second working chamber at the intake process via the water injection hole 32. This provides an effect of sealing very small gaps between members forming the working chambers, and an effect of suppressing the gaps mentioned before becoming large by absorbing compression heat and preventing thermal deformation of each member. As a result, leakage of air from the working chambers is reduced, and the efficiency is enhanced.

However, there is a possibility that part of water from the water injection hole 32 is not taken into the working chambers, and is accumulated in a space between the dust wrap 17 and the fixed wrap 16 (in particular, a space below the center O of the rotation shaft 13). Accordingly, as a feature of the present embodiment, an enclosing point P where the air is enclosed in a first working chamber formed near the outer end of the fixed wrap 16 and compression is started (specifically, a proximity point positioned on the outer side in the wrap extension direction and included in two proximity points at which the fixed wrap 16 and the orbiting wrap 22 are proximate to each other, on the contour of the first working chamber as seen in the axial direction of the rotation shaft 13) is positioned below the center O of the rotation shaft 13 and at the lowest point on the contour of the working chamber having shifted to the lowest position.

Furthermore, the fixed scroll 11 has an inclined wall surface 33 that is positioned below the center O of the rotation shaft 13, is made to face upward, and extends from the dust wrap 17 to the outer end of the fixed wrap 16. The inclined wall surface 33 is formed so as to be sloped down gradually from the dust wrap 17 toward the outer end of the fixed wrap 16. The inclined wall surface 33 according to the present embodiment entirely extends linearly when the inclined wall surface 33 is seen in the axial direction of the rotation shaft 13 (see FIG. 4).

In the thus configured present embodiment, the inclined wall surface 33 allows water to be led out to the first working chamber from the flow path 31 between the dust wrap 17 and the fixed wrap 16. Accordingly, with a simple structure (in other words, at low costs), it is possible to prevent water from being accumulated in a space between the dust wrap 17 and the fixed wrap 16. As a result, it is also possible to prevent leakage of water to the outside.

Figure 5:
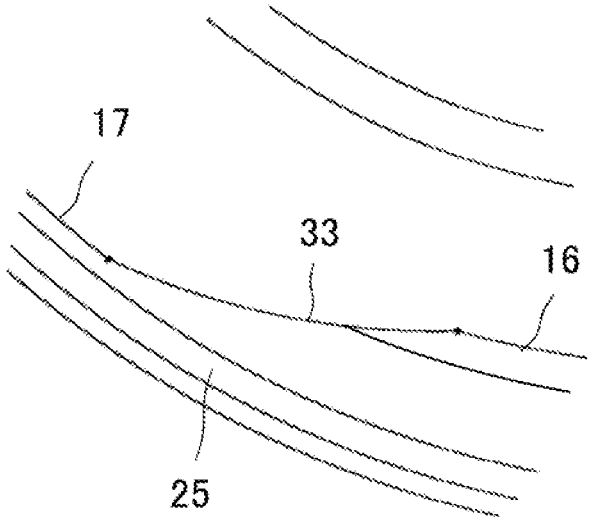
FIG. 5 is a partially enlarged view depicting the structure of the inclined wall surface in a first modification example to which the present invention is applied.
Figure 6:
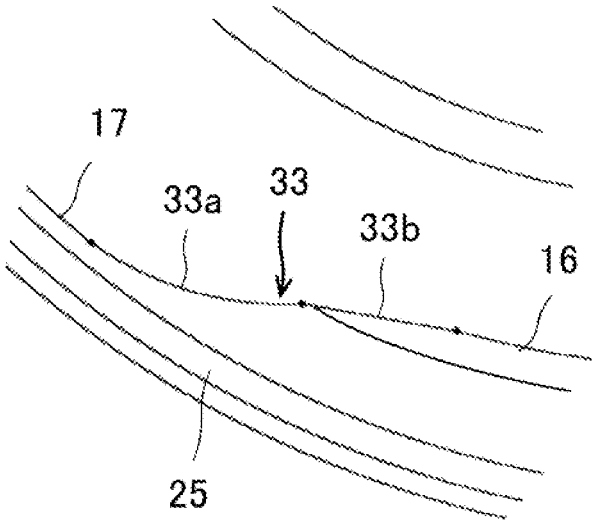
FIG. 6 is a partially enlarged view depicting the structure of the inclined wall surface in a second modification example to which the present invention is applied.
Figure 7:
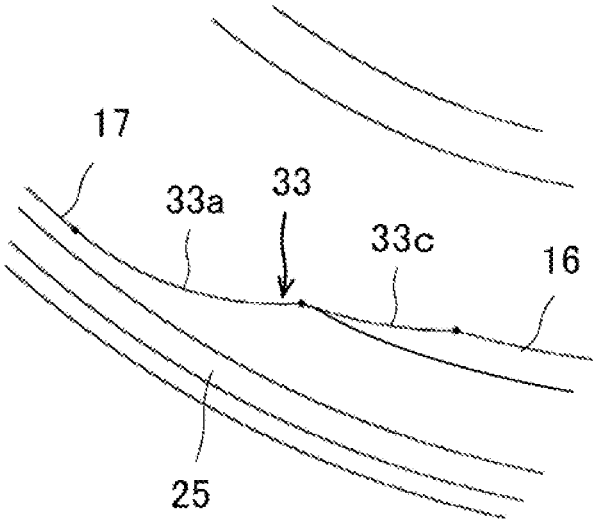
FIG. 7 is a partially enlarged view depicting the structure of the inclined wall surface in a third modification example to which the present invention is applied.
Figure 8:
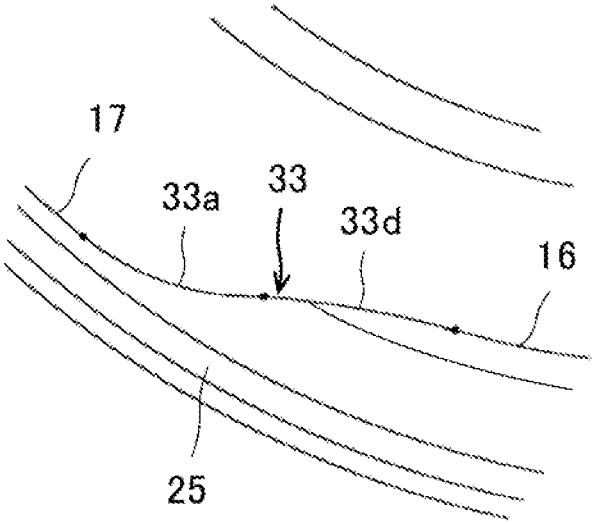
FIG. 8 is a partially enlarged view depicting the structure of the inclined wall surface in a fourth modification example to which the present invention is applied.

Note that whereas the inclined wall surface 33 entirely extends linearly when the inclined wall surface 33 is seen in the axial direction of the rotation shaft 13 in the case of the example explained in the one embodiment described above, this is not the sole example. That is, the inclined wall surface 33 only has to be formed so as to be sloped down gradually from the dust wrap 17 toward the outer end of the fixed wrap 16. For example, as in a modification example depicted in FIG. 5, the inclined wall surface 33 may entirely extend curvilinearly when the inclined wall surface 33 is seen in the axial direction of the rotation shaft 13. In addition, for example, as in a modification example depicted in FIG. 6, the inclined wall surface 33 may have a portion 33*a* that extends curvilinearly (specifically, forms a curve whose center of curvature is positioned on the upper side as depicted in the figure, for example), and a portion 33*b* that extends linearly, when the inclined wall surface 33 is seen in the axial direction of the rotation shaft 13. In addition, for example, as in a modification example depicted in FIG. 7, the inclined wall surface 33 may have the portion 33*a* that extends curvilinearly, and a portion 33*c* that extends curvilinearly (specifically, forms a curve whose center of curvature is positioned on the upper side as depicted in the figure), when the inclined wall surface 33 is seen in the axial direction of the rotation shaft 13. In addition, for example, as in a modification example depicted in FIG. 8, the inclined wall surface 33 may have the portion 33*a* that extends curvilinearly, and a portion 33*d* that extends curvilinearly (specifically, forms a curve whose center of curvature is positioned on the lower side as depicted in the figure), when the inclined wall surface 33 is seen in the axial direction of the rotation shaft 13. In these modification examples also, advantages similar to those attained in the one embodiment described above can be attained.

In addition, whereas the enclosing point P where the air is enclosed in a first working chamber formed near the outer end of the fixed wrap 16 and compression is started is positioned below the center O of the rotation shaft 13 and positioned at the lowest point on the contour of the working chamber having shifted to the lowest position in the case of the example explained in the one embodiment described above, this is not the sole example. The enclosing point mentioned before may be positioned below the center O of the rotation shaft 13 and positioned on the outer side, in the wrap extension direction, of the lowest point mentioned before. In this case also, advantages similar to those attained in the one embodiment described above can be attained.

In addition, whereas the tip seals are provided on the tip sides of the fixed wrap 16 and the orbiting wrap 22 in the case of the example explained in the one embodiment described above, this is not the sole example. As long as sufficient water sealing performance can be attained, the tip seals may not be provided at the tip sides of the fixed wrap 16 and the orbiting wrap 22.

In addition, whereas the water supply system 4 supplies water to the water injection hole 32 of the fixed scroll 11 (i.e. a position near the outer end of the orbiting wrap 22) in the case of the example explained in the one embodiment described above, this is not the sole example. The water supply system 4 may supply water to the intake flow path 18 of the fixed scroll 11 or the upstream side thereof.

In addition, whereas the rotation shaft 13 is formed as a body separate from the output shaft of the electric motor, and the rotational force of the electric motor is transferred via the pulley or the like in the case of the example explained in the one embodiment described above, this is not the sole example. The rotation shaft may be coaxially connected with the output shaft of the electric motor, or may be formed integrally with the output shaft of the electric motor.

DESCRIPTION OF REFERENCE CHARACTERS

11: Fixed scroll
12: Orbiting scroll
13: Rotation shaft
15: Mirror plate
16: Fixed wrap
17: Dust wrap
21: Mirror plate
22: Orbiting wrap
33: Inclined wall surface

The invention claimed is:

1. A scroll compressor comprising:

a fixed scroll having a mirror plate, a fixed wrap that is arranged upright on the mirror plate and extends helically, and an annular dust wrap that is arranged upright on the mirror plate and arranged on an outer circumference side of the fixed wrap;

an orbiting scroll having a mirror plate and an orbiting wrap that is arranged upright on the mirror plate and extends helically; and a rotation shaft that extends in a horizontal direction and causes the orbiting scroll to orbit relative to the fixed scroll, wherein the mirror plate of the fixed scroll has a liquid injection hole positioned above a center of the rotation shaft, liquid is injected to a working chamber via the liquid injection hole and a flow path between the dust wrap and the orbiting wrap, the working chamber being formed near an outer end of the fixed wrap and on an inner side in a widthwise direction of the fixed wrap, an enclosing point where the gas is enclosed in the working chamber and where compression is started is positioned below the center of the rotation shaft and positioned at a lowest point on a contour of the working chamber having shifted to a lowest position or positioned on an outer side of the lowest point in the wrap extension direction, the fixed scroll further has an inclined wall surface that is positioned below the center of the rotation shaft, is made to face upward, and extends from the dust wrap to the outer end of the fixed wrap, and the inclined wall surface has a shape that is sloped down gradually from the dust wrap toward the outer end of the fixed wrap.

2. The scroll compressor according to claim 1, wherein the inclined wall surface entirely extends linearly when the inclined wall surface is seen in an axial direction of the rotation shaft.

3. The scroll compressor according to claim 1, wherein the inclined wall surface entirely extends curvilinearly when the inclined wall surface is seen in an axial direction of the rotation shaft.

4. The scroll compressor according to claim 1, wherein the inclined wall surface has a portion that extends linearly and a portion that extends curvilinearly when the inclined wall surface is seen in an axial direction of the rotation shaft.

5. The scroll compressor according to claim 1, wherein the inclined wall surface has a plurality of portions that extend curvilinearly when the inclined wall surface is seen in an axial direction of the rotation shaft.

6. The scroll compressor according to claim 1, wherein the liquid injection hole is positioned near an outer end of the orbiting wrap.

* * * * *